United States Patent [19]

Geller et al.

[11] 4,422,379

[45] Dec. 27, 1983

[54] MEANS FOR AND A METHOD OF INITIATING EXPLOSIONS

[75] Inventors: John M. E. Geller, Loans; John P. Wilson, Kilwinning, both of Scotland

[73] Assignee: Imperial Chemical Industries PLC, Millbank, England

[21] Appl. No.: 331,081

[22] Filed: Dec. 15, 1981

[30] Foreign Application Priority Data

Jun. 22, 1981 [GB] United Kingdom ..... 8119236

[51] Int. Cl.[3] ..... F42C 11/00; F42D 1/00

[52] U.S. Cl. ..... 102/206

[58] Field of Search ..... 102/206, 217, 218; 361/247, 248

[56] References Cited

U.S. PATENT DOCUMENTS

| | | | |
|---|---|---|---|
| 2,396,914 | 3/1946 | Cook | 102/409 |
| 3,166,689 | 1/1965 | Butenbach | 102/202.7 |
| 3,171,063 | 2/1965 | Hutchison et al. | 102/206 |
| 3,255,266 | 6/1966 | McNulty | 102/218 |
| 4,041,870 | 8/1977 | Ettel | 102/109 |
| 4,141,297 | 2/1979 | Sellwood | 102/206 |
| 4,273,051 | 6/1981 | Stratton | 102/206 |
| 4,297,947 | 11/1981 | Jones et al. | 102/206 |

FOREIGN PATENT DOCUMENTS

| | | |
|---|---|---|
| 5377 | 11/1979 | European Pat. Off. . |
| 2294424 | 7/1976 | France . |
| 646013 | 11/1950 | United Kingdom . |
| 1276766 | 6/1972 | United Kingdom . |
| 1421578 | 1/1976 | United Kingdom . |
| 2022222 | 12/1979 | United Kingdom . |
| 1558875 | 1/1980 | United Kingdom . |
| 1578658 | 11/1980 | United Kingdom . |

*Primary Examiner*—Charles T. Jordan

*Attorney, Agent, or Firm*—Cushman, Darby & Cushman

[57] ABSTRACT

An alternating current generator for use as a shot exploder suitable for firing electric detonators coupled through toroid transformers e.g. 'Magnadet' detonators. The detonating system is energized by means of a signal that is automatically generated at the resonant frequency, thus avoiding the usual time-consuming and dangerous practice involving in-situ determination of inductance and selection of capacitors.

14 Claims, 6 Drawing Figures

MEANS FOR AND A METHOD OF INITIATING EXPLOSIONS

This invention relates to a means for and a method of initiating explosions. More particularly, it relates to a means and method utilisable with toroid coupled detonators such as that developed by ICI and marketed under the trade name "Magnadet".

Toroid coupled detonators such as that described above are used together with ferrite rings. Each detonator has its own associated ring, with the leading wire from each detonator being threaded several times (typically 4 turns) about its associated ring, to form a secondary circuit. The length of the leading wires is such as to ensure that the rings are situated at the mouth of each blast hole and energy is fed from an exploder to the system via a primary wire which is threaded once only through each ring.

With such a system described above, an attractive feature is the frequency selective characteristics of the ferrite rings. Thus, the rings have a band-pass characteristic which effectively attenuates low frequency signals having a frequency below about 10 kHz and high frequency signals having a frequency above about 100 kHz. Thus, as the leading wire of each detonator constitutes an isolated closed loop the detonators are substantially immune to stray currents and earth leakage.

A problem with such systems is that at frequencies of 15–25 kHz (which is the frequency range in which the best energy transfer is obtained via the ferrite rings) there is a considerable loss of firing energy due to the inductance of the system.

The applicant is aware that an attempt has been made to overcome this problem by utilising a series capacitor in an attempt to operate the system in a series resonant mode.

However, it will be appreciated, that the inductance of the system will vary in accordance with the number of ferrite ring and associated detonator units utilised, the configuration of the primary wire, and the like. Thus, if a shot exploder is used which generates a detonating signal at a fixed frequency, then each system will require a series capacitor having a particular capacitance that will result in series resonance at the fixed frequency. It is thus necessary to measure the inductance of each system in situ, compute the capacitance required, select a suitable capacitor from a stock thereof, and then insert the capacitor in circuit with the system. This procedure is time consuming, dangerous, and requires a stock of capacitors and skilled personnel.

Accordingly, the invention provides a means for initiating explosions, which includes

- a power oscillator means for generating an oscillating electric initiating signal of sufficient power at a variable frequency;
- a frequency setting means to which the generator means is responsive whereby in use, when the power oscillator means is connected to a load it automatically generates a signal at the resonant frequency of the load.

The explosion initiating means may be a shot exploder. The shot exploder may then have output connecting means to which the ends of a primary wire forming part of a detonating system as described above are connected. A resonance capacitor may be serially connected with the output connecting means.

Further according to the invention there is provided a method of initiating explosions, which includes

- providing a detonating system that is operable by an oscillating electric signal and which has an undetermined impedance; and
- automatically generating an oscillating initiating signal at the resonant frequency of the system.

The invention extends to an initiating means as described, in combination with and connected to an A.C. operable detonating system.

In one embodiment, the power oscillator means may include at least one controllable element and the frequency setting means may include a positive feedback link for controlling operation of the element in accordance with the voltage or current supplied to the detonating system. The, or each, controllable element may be switchable and may conveniently be switchable on and off, such as a transistor. This switchable element is then switched in phase with the initiating signal. Alternatively, the power oscillator means may include an amplifier.

One form of feedback link may include a detector which senses the current in the output circuit and an amplifier responsive to the detector providing a current output in phase with the initiating signal current to control the switchable element or elements. The detector and amplifier link is advantageous for high power requirements.

The explosion initiating means may also advantageously include a voltage setting means to provide a predetermined firing current into any fixed load within the operational impedance range of the power oscillator.

As a further feature, an auxiliary inductance may be provided for reducing the resonant range. This auxiliary inductance may be in series with the connecting means.

The power oscillator means may be D.C. operable and the voltage setting means may then include a controllable voltage supply means for supplying to the power oscillator a variable voltage D.C. supply and a sensing means for sensing the magnitude of current supplied, in use, to the detonating system, the voltage supply means being responsive to the sensing means.

The shot exploder of the invention makes it unnecessary first to determine the inductance of a detonating system and then to compensate therefor by means of a resonance capacitor to obtain a predetermined resonant frequency. Thus, the detonating system in energised by means of a signal that is automatically generated at the resonant frequency.

The invention is now described, by way of examples with reference to the accompanying drawings, wherein all like components are similarly referenced and in which.

Figure 1:
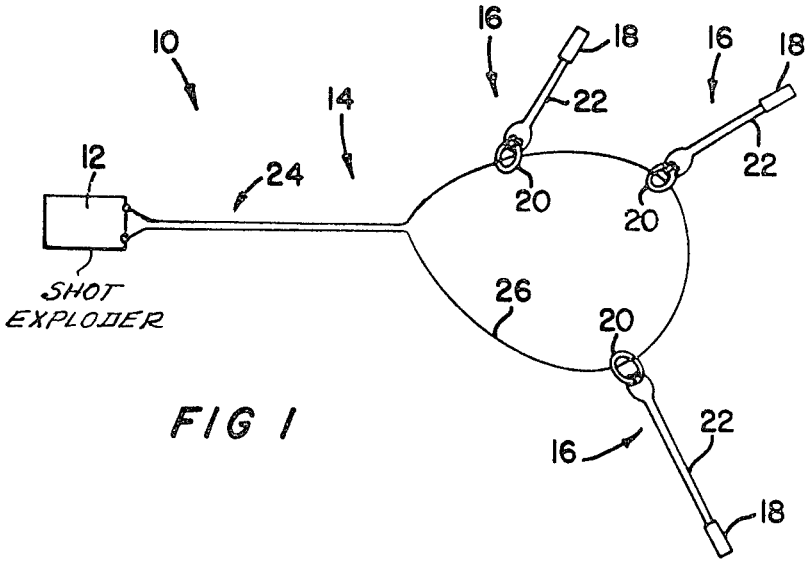
FIG. 1 shows schematically a detonating system of the type with which a shot exploder in accordance with the invention is used.

Reference is initially made to FIG. 1. Shown therein generally by reference numeral 10 is a detonating arrangement. The detonating arrangement 10 comprises a shot exploder 12 connected to a detonating system 14. The detonating system 14 comprises a number of detonating modules 16. Each detonating module 16 comprises a standard electric detonator 18 which is coupled with a ferrite ring 20 by means of a loop of leading wire 22. As shown, each leading wire 22 is wound a few times around its ferrite ring 20. The detonating system 14 further comprises a firing cable 24 and a primary wire loop 26, the latter being passed through the ferrite rings 20. Further as shown, one end of the firing cable 24 is connected to the shot exploder 12 and the other end to the primary wire loop 26.

Figure 2:
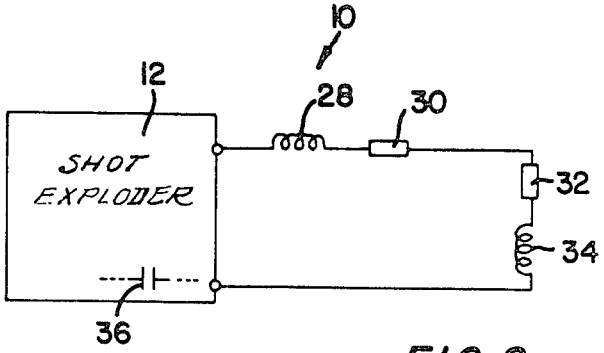
FIG. 2 shows an equivalent circuit of the detonating system.

Referring now to FIG. 2, an equivalent circuit diagram of the detonating arrangement 10 is shown. Thus, the firing cable 24 and primary wire loop 26 are represented by an inductance 28 and a resistance 30 whereas the detonating modules 16, as referred back to the primary loop 26, are represented by a resistance 32 and an inductance 34. The inductance 28 typically has a value of 60–600 $\mu$H and the resistance 30 has a value of 5–10 ohm. Similarly, the resistance 32 has a value of $N \times 0.125$ ohm where N is the number of detonators and the inductance 34 has a value of $N \times 2.5$ $\mu$H. As indicated earlier, the ferrite rings 20 are frequency selective and have an optimal energy transfer characteristic in the frequency range of 15-25 kHz. It will thus further be appreciated that at these frequencies the inductive characteristic of the detonating system 14 is significant. In order to eliminate the inductive effect the shot exploder 12 incorporates a series capacitor 36 which is of a suitable value so that when used with detonating systems 14 of a specified type the series resonant circuit formed thereby has a resonant frequency between 15 and 25 kHz.

Figure 3:
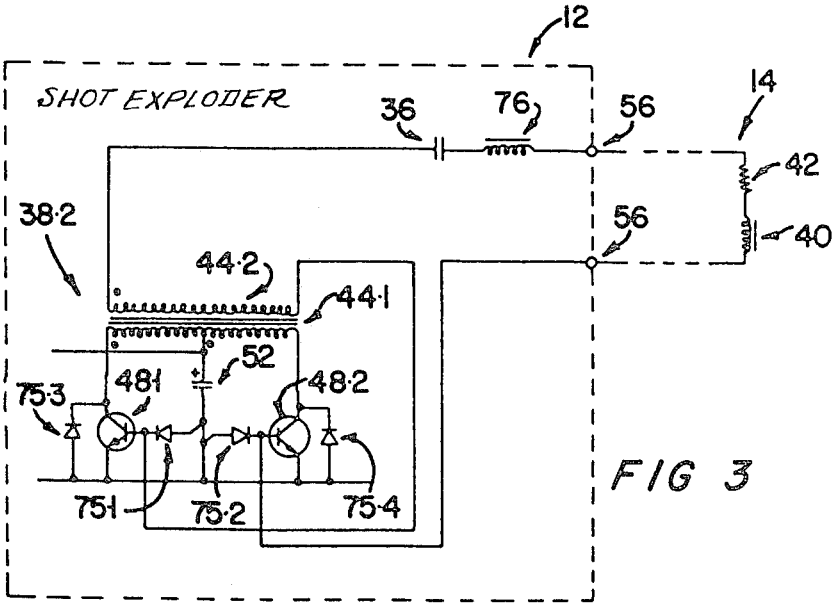
FIG. 3 shows a circuit diagram of a power oscillator utilising a direct feedback link.

Referring now to FIG. 3, shown therein is a power oscillator arrangement 38.2 which is connected to the detonating system 14. In FIG. 3, the inductances and resistances shown in FIG. 2 have been lumped together to provide an inductance 40 and a resistance 42. Also included in the circuit is an inductance 76 which reduces the resonant frequency range. The oscillator arrangement 38.2 further has a transformer 44.1. The secondary winding 44.2 of transformer 44.1 is serially connected with the detonating system 14 via the transistors 48.1 and 48.2, the additional inductor 76 and the resonance capacitor 36 and these comprise a series resonant circuit. At the heart of the oscillator arrangement 38.2 are transistors 48.1 and 48.2 which are controlled by a feedback loop from the series resonant circuit. In order to protect the base-emitter junctions of the transistors 48.1 and 48.2 and to provide a reverse path for the feedback current reverse polarity free-wheeling diodes 75.1 and 75.2 are provided. An energy storage capacitor 52 is also provided.

Free-wheeling diodes 75.3 and 75.4 allow a safe rundown of system energy if the option of stopping the signal after a predetermined time is taken.

It will be appreciated that the oscillator arrangement 38.2 is self-tuning in that it will generate an oscillating signal at the resonant frequency of the circuit formed by the transformer 44.1, the feedback elements 48.1, 48.2, 75.1, 75.2, the additional inductor 76, the resonance capacitor 36 and the detonating system 14. Thus, in operation, once the oscillator arrangement 38.2 is triggered, for example by switching on transistor 48.1, current starts to flow into the base of transistor 48.1 via diode 75.1 and the remainer of the resonant circuit. The polarity of the secondary winding 44.2 is chosen such that positive feedback to the transistors 48.1 and 48.2 is provided. Thus the transistor 48.1 remains switched on while the output current flows in the original direction. When current flow reverses the transistor 48.1 is turned off and the transistor 48.2 is turned on. With the next reversal of current polarity, to the original direction, the transistor 48.1 is switched on again and the process is repeated. The positive feedback signal applied to the switching transistors 48.1 and 48.2 is equal to the load current and is always in phase with it. The oscillator arrangement 38.2 accordingly generates a signal at the resonant frequency of the load, providing the inductance of the load circuit is within reasonable limits (say 50 $\mu$H to 1 mH).

Although the transformer 44.1 produces a square-wave output voltage signal, the current in the firing loop is sinusoidal as known from the theory of resonant circuits. The firing current therefore contains a low proportion of harmonic frequencies. This is a very useful feature of the exploder-although the harmonics consume the exploder output power, they are attenuated by the ferrite rings and by the inductance of the detonator leading wires and therefore they contribute very little to the transfer of energy to the detonators.

Figure 4:
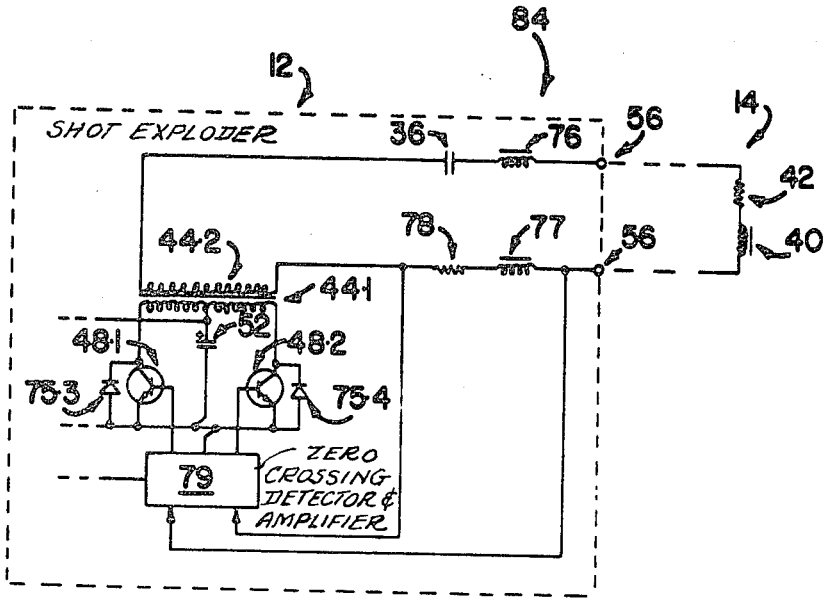
FIG. 4 shows a circuit diagram of an alternative power oscillator utilising a current detector and amplifier feedback link.

Reference is now made to FIG. 4, which shows a power oscillator arrangement wherein a detector and amplifier circuit 79 supplies the necessary positive feedback signal to transistors 48.1 and 48.2. It will be appreciated that when a series tuned circuit is driven at its resonant frequency, the resulting current is in phase with the drive voltage. For a square wave drive voltage the current therefor crosses zero at the instant the drive voltage changes polarity.

The voltage across series resistor 78 is a measure of the current in the series tuned circuit.

By monitoring the voltage across resistor 78, and causing the respective drives to transistors 48.1 and 48.2 to reverse at the instant the said voltage crosses zero, the drive will be oscillating at the resonant frequency.

The detection and amplification of the feedback voltage across resistor 78 is carried out by the zero-crossing detector and amplifier circuit 79. To compensate for propagation delays in circuit 79, a small series inductor 77 is included to advance the feedback voltage signal relative to the current in the tuned circuit. If the circuit 79 is polarity dependent, the polarity of secondary winding 44.2 will need to be defined.

It will be appreciated that the circuits of FIGS. 3 to 4 will supply the detonating system 14 with a firing current that will vary depending on the load. However, it is generally desirable that the firing current be above a certain specified minimum level in order to minimise the delay time spread of delay detonators and below a certain maximum level in order to protect circuit components from being overrun.

Figure 5:
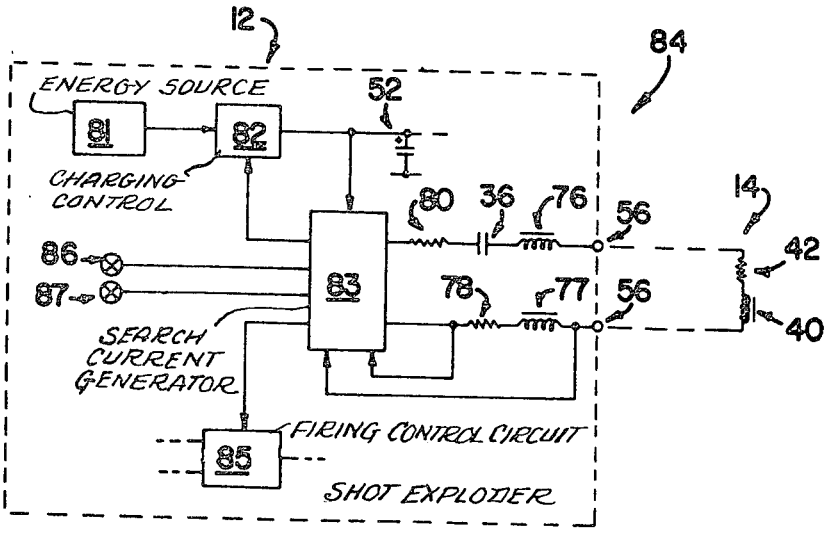
FIG. 5 shows a circuit diagram including a further oscillator for use in association with a power oscillator in a shot exploder to give a pre-set output voltage.

The circuit of FIG. 5 is designed to preset the output voltage of the circuits of FIGS. 3 and 4 according to the value of the load, thereby giving a constant output current above the specified minimum level.

In the circuits of FIGS. 3 and 4 the secondary voltage of the transformer 44.1 within its linear range (ingoring losses), will be given by $$E = tV_{STG} \quad (1)$$

where

E is the secondary voltage, t is the transformer turns ratio, and $V_{STG}$ is the voltage on capacitor 52.

Referring to FIG. 4, the series circuit 84, to which the voltage E is applied to initiate detonating system 14, comprises capacitance 36, inductance 76, detonating system 14, inductance 77 and resistance 78.

As the series circuit 84 operates in a series resonant mode, the load impedance as seen by an applied voltage e will appear resistive and will conform to the basic electrical equation $$e = ir \quad (2)$$

Where e is the applied votage i is the resulting current, and r is the load resistance.

The total resistance $R_T$ of the series circuit 84 (as seen by the applied voltage e) is the sum of the resistances included in the said series circuit (42 and 78), the resistive losses of the reactive components in the said series circuit at the driven frequency (36, 76 and 77) and the resistive losses in the transformer 44.1. Thus, from equation (2) the current i produced in resistance $R_T$ when voltage e is applied is given by the equation $$i = 1/R_T \times e \quad (3)$$

In particular, from equations (1) and (3), if the capacitor 52 is charged to a value $V_{STG}$, the power oscillator output voltage will be $tV_{STG}$, and the resulting load current I is given by the equation $$I = 1/R_T \times tV_{STG} \quad (4)$$

The oscillator shown in FIG. 5 generates a search current in the series circuit 84 for determining the supply voltage required for the power oscillators of FIGS. 3 and 4 to deliver the necessary firing current. This oscillator self-tunes in a similar manner to that described for FIG. 4, thereby determining if the resonant frequency and the load resistance are within the required ranges.

If the output voltage of the search current generator is a fixed portion of the power oscillator output voltage, from equation (3) the resulting search current will be the same fixed proportion of the expected firing current. Denoting that proportion as 1/S, then from equation (4)

$$I \times 1/S = 1/R_T \times tV_{STG} \times 1/S \quad (5)$$

where $tV_{STG} \times 1/s$ is the oscillator output voltage and the resulting search current is $I \times 1/S$.

It will be apparent that the value of S must be such that the current is insufficient to initiate the detonating system 14.

It will be seen from equations (4) and (5) that when the search current reaches a value of $I_f \times I/S$, where $I_f$ is the desired firing current to initiate the detonating system 14, the value of $V_{STG}$, the voltage on capacitance 52, will be sufficient for a power oscillator of any of FIGS. 3 to 4 to initiate the detonating system.

In the circuit of FIG. 5 circuit 83 is the search current generator which also measures the amplitude of the search current produced.

Circuit 82 is a charging control circuit interposed between an energy source 81 and the energy storage capacitance 52. Circuit 82 will include a switchable element such as a transistor to enable the charging current to be stopped at the required $V_{STG}$ in response to a signal from circuit 83.

Circuit 85 is a firing control circuit which is also responsive to circuit 83, to provide the triggering signal for a power oscillator of any one of FIG. 3 or 4.

Indicator 86 shows when the exploder is ready to fire, and indicator 87 shows that the load is outside the specified range of the exploder 12.

The operation of the circuit of FIG. 5 begins with the connection of the series circuit 84 to the output of the search current generator 83.

A resistance 80 is included in series with the said output to simulate the resistive losses in the transformer 44.1 of FIG. 4, and also to modify the relation between the expected firing current $I_f$ and the total resistance of the series circuit $R_T$. The modification is arranged to allow for the fact that while an approximately constant current is drawn from capacitance 52 when firing, resulting in an approximately constant rate of voltage decay, the percentage rate of voltage decay is greater when the initial voltage is lower. The percentage rate of firing current decay is therefore greater when the load resistance is low. Low resistance loads are therefore given a higher initial firing current than high resistance loads for constant impulse energy.

The exploder energy source 81 is then connected via the charging control circuit 82 to the energy storage capacitance 52.

As the voltage on capacitance 52 increases, the output voltage of the search current generator 83 also increases as indicated in equation (5) above.

When the amplitude of the search current reaches a value of $I_f \times I/S$, further charging of capacitance 52 is prevented by a trip signal from circuit 83 to circuit 82. Circuit 85 is simultaneously signalled by circuit 83 that the exploder is ready to fire, and indicator 86 is energised.

Figure 6:
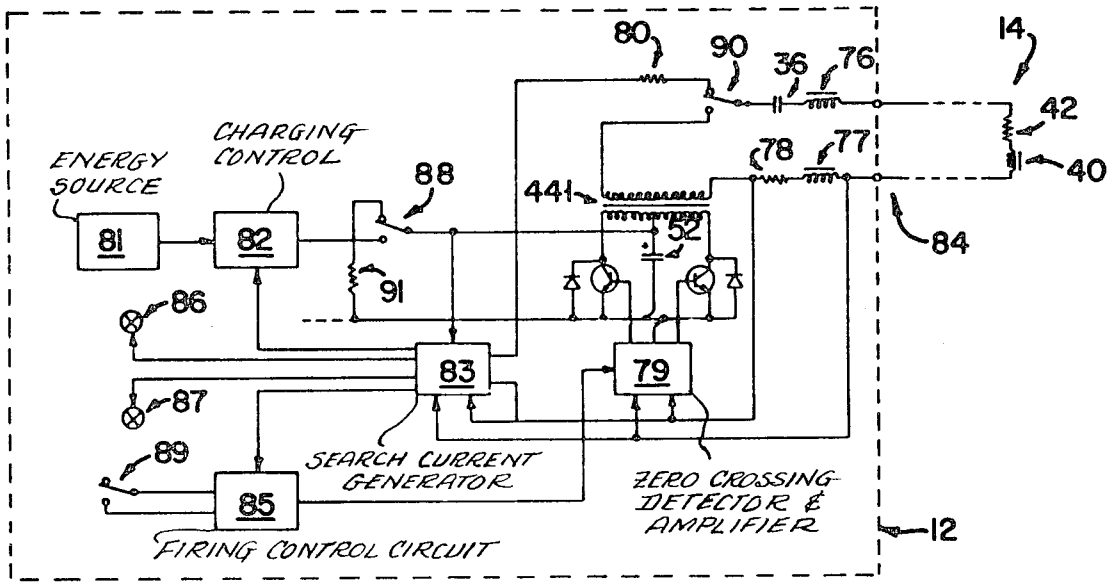
FIG. 6 shows a circuit diagram of a shot exploder in accordance with the invention, incorporating the circuits of FIGS. 4 and 5.

In the circuit of FIG. 6 switch 88 is a safety switch (shown in the normal or safe position) whereby the capacitance 52 is discharged via resistance 91. Firing switches 89 and 90 are ganged, and are shown in the normal or test position.

In the operational sequence for firing a detonating system 14, switch 88 is operated and the part of the shot exploder circuit as shown in FIG. 5 is completed.

Capacitor 52 will start charging from the energy source 81 (which may be a hand cranked generator), via the charging control circuit 82. Concurrently, the search current generator 83 will apply an alternating voltage, self-tuning to the resonant frequency of the series circuit 84, having an amplitude proportional to the instantaneous voltage on capacitor 52. When the resulting search current is of the required amplitude, circuit 83 will simultaneously signal circuit 82 to prevent further charging, signal circuit 85 that the exploder is ready to fire, and energise indicator 86.

Switch 88 should remain operated, and switches 89 and 90 should not be operated. The part of the shot exploder circuit from FIG. 4 is now completed.

Circuit 85 triggers circuit 79 to start the firing sequence as described for FIG. 4, and can stop the sequence after a predetermined time if required.

Every shot exploder has specified limits to the load impedance into which it is capable of firing the required initiating current. Thus, in a shot exploder of this invention the circuit component ratings dictate the maximum allowable voltage on capacitance 52, and hence the maximum allowable load resistance.

Also, the maximum and minimum values of oscillating current frequency to which the detonating system 14 will respond efficiently and/or to which the shot exploder circuitry can respond, will dictate the minimum and maximum values of load inductance 40 that can be tolerated, given the values of capacitance 36 and inductances 76 to 77. The resonant frequency of the series circuit 84 is given approximately by the equation $$f = \frac{1}{2\pi\sqrt{L \times C}}$$

where L is the total inductance of the said series circuit, the sum of inductances 40, 76 and 77, and C is capacitance 36.

In a shot exploder according to the invention incorporating the circuit of FIG. 6, preliminary measurements of the search current are used to ensure that the separate limits of load resistance and inductance are not exceeded. If any limit is exceeded, circuit 83 will signal that the load is outside the specified range, that the exploder is not ready to fire, and indicator 87 is energised. The exploder is therefore inhibited from firing even if switches 89 and 90 are operated in an attempt to fire.

A shot exploder according to the circuit of FIG. 6 will therefore provide a constant current firing output into a detonating system of undetermined impedance. The firing circuit components are thus protected from overload, and the exploder is efficient in the use of energy from its energy source.

The shot exploder circuit of FIG. 6 also provides a time-delay self-discharge mechanism to prevent a partially or fully charged exploder from remaining in that state any longer than necessary.

We claim:

1. A means for initiating explosions which includes a power oscillator means for generating an oscillating electric initiating signal of sufficient power at a variable frequency;

a frequency setting means to which the oscillator means is responsive whereby, in use, when the power oscillator means is connected to a load it automatically generates a signal at the resonant frequency of the load.

2. An explosion initiating means as claimed in claim 1, which includes an output connecting means for connection to a primary wire of an A.C. operable detonating system.

3. An explosion initiating means as claimed in claim 2, in which the frequency setting means includes a resonance capacitor serially connected with the output connecting means.

4. An explosion initiating means as claimed in claim 3, in which the power oscillator means includes an amplifier means and the frequency setting means is connected in a positive feedback manner to the amplifier means.

5. An explosion initiating means as claimed in claim 3, in which the power oscillator means includes a switchable element and the frequency setting means is controllably connected with the switchable element to switch it, in use, in phase with the initiating signal.

6. An explosion initiating means as claimed in claim 3, in which the power oscillator means includes an output transformer.

7. An explosion initiating means as claimed in claim 6, in which the output transformer is an isolating transformer having a primary winding and a secondary winding, the secondary winding being serially connected with the connecting means.

8. An explosion initiating means as claimed in claim 3, which includes a voltage setting means to provide, in use, a predetermined initiating current to a detonating system connected thereto, the detonating system having any resistive impedance within a predetermined operational range.

9. An explosion initiating means as claimed in claim 8, in which the power oscillator means is D.C. operable and the voltage setting means includes a controllable voltage supply means for supplying to the power oscillator a variable voltage D.C. supply and a sensing means for sensing the magnitude of current supplied, in use, to the detonating system, the voltage supply means being responsive to the sensing means.

10. An explosion initiating means as claimed in claim 5, in which the frequency setting means includes a feedback voltage generating impedance in series with the output connecting means and a zero-crossing detector and amplifier unit, the voltage across the said impedance being supplied to the detector and amplifier unit, the detector and amplifier unit being connected with the switchable element.

11. An explosion initiating means as claimed in claim 10, in which the feedback voltage generating impedance comprises a resistor and an inductance.

12. An explosion initiating means as claimed in claim 3, which includes an auxiliary inductance for reducing the resonant range in series with the output connecting means.

13. An explosion initiating means as claimed in claim 1, in combination with and connected to an A.C. operable detonating system.

14. A method of initiating explosions, which includes providing a detonating system that is operable by an oscillating electric signal and which has an undetermined impedance; and automatically generating an oscillating initiating signal at the resonant frequency of the system.

* * * * *